US008092001B2

(12) United States Patent
Yamada et al.

(10) Patent No.: US 8,092,001 B2
(45) Date of Patent: Jan. 10, 2012

(54) LIQUID JETTING APPARATUS

(75) Inventors: Takahiro Yamada, Toyoake (JP); Naoya Okazaki, Gifu (JP); Yoichiro Shimizu, Kasugai (JP); Masaru Someya, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1046 days.

(21) Appl. No.: 12/005,742

(22) Filed: Dec. 28, 2007

(65) Prior Publication Data

US 2008/0158322 A1 Jul. 3, 2008

(30) Foreign Application Priority Data

Dec. 29, 2006 (JP) ..... 2006-356904

(51) Int. Cl.
*B41J 2/19* (2006.01)
*B41J 2/17* (2006.01)
*B41J 2/175* (2006.01)

(52) U.S. Cl. ..... 347/92; 347/84; 347/85

(58) Field of Classification Search ..... 347/84, 347/85, 86, 92
See application file for complete search history.

(56) References Cited

U.S. PATENT DOCUMENTS

| | | | | |
|---|---|---|---|---|
| 5,485,187 | A | 1/1996 | Okamura et al. | |
| 2005/0088494 | A1 | 4/2005 | Shimizu et al. | |
| 2006/0268050 | A1 * | 11/2006 | Sonobe | 347/29 |
| 2008/0291249 | A1 * | 11/2008 | Jung et al. | 347/85 |

FOREIGN PATENT DOCUMENTS

| | | |
|---|---|---|
| JP | 2122938 | 5/1990 |
| JP | 5-92578 | 4/1993 |
| JP | 2005-169892 | 6/2005 |

* cited by examiner

*Primary Examiner* — Matthew Luu
*Assistant Examiner* — Jannelle M Lebron
(74) *Attorney, Agent, or Firm* — Frommer Lawrence & Haug LLP

(57) ABSTRACT

A liquid jetting apparatus includes: a head; an ink storage chamber communicating with the head; a gas distributing chamber in which a gas introducing hole is formed; a buffer chamber in which a communicating hole for communicating with the gas distributing chamber, and an atmosphere opening hole for opening to the atmosphere are formed; a combination valve which is capable of opening and closing the gas introducing hole and the communicating hole; a gas introducing mechanism which introduces the compressed air through the gas introducing hole to the head to jet the ink forcibly, and a positive-pressure control valve which opens the atmosphere opening hole when a pressure in the buffer chamber exceeds a predetermined value. It is possible to operate a positive-pressure purge while suppressing an excessive increase in the pressure inside the liquid storage chamber, without increasing a size and a cost of the apparatus.

12 Claims, 8 Drawing Sheets

LIQUID JETTING APPARATUS

CROSS REFERENCE TO RELATED APPLICATION

The present application claims priority from Japanese Patent Application No. 2006-356904, filed on Dec. 29, 2006, the disclosure of which is incorporated herein by reference in its entirety.

BACKGROUND OF THE INVENTION

1. Field of the Invention

The present invention relates to a liquid jetting apparatus such as an ink-jet recording apparatus which records an image on a recording medium by jetting an ink from a jetting head.

2. Description of the Related Art

For example, in an ink-jet recording apparatuses described in Japanese Patent Application Laid-open No. H5-92578, when a viscosity of an ink in a nozzle hole of a jetting head is increased due to not using the apparatus for a long time, or when there is a blocking of the nozzle hole due to mixing of an impurity etc., a positive-pressure purge operation is carried out. In the positive-pressure purge operation, an inside of an ink tank which communicates with the jetting head is pressurized, and the ink is jetted forcibly from the nozzle holes, and a function of the jetting head is recovered by the positive-pressure purge operation.

Incidentally, when a temperature change is occurred in the apparatus, an excessive positive pressure might be generated inside the ink tank of a fixed volume. When the excessive positive pressure is generated, the positive pressure is propagated from the ink tank to the nozzle hole of the jetting head, and a favorable meniscus in the nozzle hole might be destroyed. In an ink-jet recording apparatus described in Japanese Patent Application Laid-open No. 2005-169892, an atmosphere opening hole (an air vent hole) is formed in the ink tank, and this atmosphere opening hole is covered by a positive-pressure control valve on which a bias is applied by a spring, in a direction of closing. According to such structure, only when the excessive positive pressure is generated inside the ink tank, the positive-pressure control valve moves against the bias of the spring. Accordingly, the atmosphere opening hole is opened, and a pressure fluctuation (pressure change) in the ink tank is suppressed.

SUMMARY OF THE INVENTION

However, in the abovementioned positive-pressure purge operation for the ink tank having the positive-pressure control valve, when the positive pressure for the purge is supplied to the ink tank and the pressure inside the tank is increased, the positive-pressure control valve opens the atmosphere opening hole, and the pressure is leaked to an exterior through the atmosphere opening hole. When the pressure is leaked, since sufficient positive pressure is not propagated from the ink tank to the nozzle hole of the jetting head, there arises a need to use a high pressure pump for the pump which supplies the positive pressure for purge, which causes an increase in a size of the apparatus, and a high cost.

In view of this, an object of the present invention is to provide a positive-pressure purge function without increasing the size and the cost of the apparatus, while suppressing an excessive increase in the pressure inside a liquid storage chamber.

The present invention is made in view of the abovementioned circumstances, and according to the first aspect of the present invention, there is provided a liquid jetting apparatus which jets a liquid, including:

a head which jets the liquid;

a liquid storage chamber which communicates with the head, and in which the liquid to be supplied to the head is stored;

a gas distributing chamber communicating with the liquid storage chamber, and having a gas introducing hole in which a gas, to be fed to the liquid storage chamber, is formed;

a first valve which opens and closes the gas introducing hole;

a gas introducing mechanism which introduces the gas through the gas introducing hole to feed the liquid in the liquid storage chamber to the head so that the liquid is forcibly jetted from the head;

a buffer chamber having a communicating hole and an atmosphere opening hole formed therein, the communicating hole communicating with the gas distributing chamber, and the atmosphere opening hole introducing an atmosphere;

a positive-pressure control valve which opens the atmosphere opening hole when a positive pressure inside the buffer chamber exceeds a predetermined value; and a second valve which opens and closes the communicating hole. The first valve and the second vale are formed integrally.

In the liquid jetting apparatus of the present invention, when the communicating hole is in an open state, the buffer chamber (pressure absorbing chamber) communicates with the liquid storage chamber via the gas distributing chamber. In this state, when an excessive pressure is generated in the liquid storage chamber, the positive-pressure valve of the buffer chamber communicating with the liquid storage chamber is opened to the atmosphere, and an excessive increase in the pressure inside the liquid storage chamber is suppressed. On the other hand, in a case of pressurizing the liquid storage chamber by introducing the gas through the gas introducing (infusing) hole (so-called positive-pressure purge operation), the communicating hole is closed by the second valve. At this time, since the positive pressure of the liquid storage chamber is not transmitted to the buffer chamber, the pressure is not leaked to the outside from the positive-pressure control valve. Accordingly, it is not necessary to use a high pressure pump for a pump which supplies the positive pressure for purge, and it is possible to prevent an increase in a size and a cost of the apparatus.

Furthermore, with the communicating hole in the open state, since an overall volume of a space communicating with the liquid storage chamber through the buffer chamber communicating with the gas distributing chamber, it is possible to suppress a pressure fluctuation due to the buffer chamber. On the other hand, at the time of the positive-pressure purge, since it is possible to close the communicating hole by a cutoff valve (an isolation valve), the volume of the space communicating with the liquid storage chamber is decreased by an amount equivalent to a volume of the buffer chamber. Therefore, the pressure is susceptible to be transmitted to the jetting head. Accordingly, the pressure which is necessary for the pump supplying the positive pressure for purge is absorbed, and it is possible to prevent the increase in the size and the cost of the apparatus.

Furthermore, since the first valve which opens and closes the gas introducing hole, and the second valve which opens and closes the communicating hole are formed integrally, it is not necessary to provide independently a valve for the gas introducing hole and a valve for the communicating hole. Moreover, as compared to a case of providing these valves independently, it is possible to reduce the number of driving sources. Accordingly, a structure of the apparatus can be simplified facilitating a further reduction in space, and it is possible to reduce the number of components and the cost of the apparatus.

In the liquid jetting apparatus of the present invention, an air layer may be formed in the liquid storage chamber, and the gas introducing hole may communicate with the air layer. In this case, since the gas introducing hole communicates with the air layer of the liquid storage chamber, no air bubbles are generated in the liquid at the time of supplying the gas to the liquid storage chamber.

In the liquid jetting apparatus of the present invention, when the first valve opens the gas introducing hole, the second valve may close the communicating hole; and when the first valve closes the gas introducing hole, the second valve may open the communicating hole. In this case, it is possible to prevent suitably the increase in the size and the cost of the apparatus as it has been described above.

In the liquid jetting apparatus of the present invention, the gas introducing hole may be formed to face the communicating hole;

the liquid jetting apparatus may further include a bias applying mechanism which applies a bias in a direction in which the first valve is separated away from the communicating hole to close the gas introducing hole; and when the first valve opens the gas introducing hole against the bias applied by the bias applying mechanism, the second valve may close the communicating hole.

In this case, since the liquid jetting apparatus includes the bias applying mechanism which applies bias on the first valve, in a direction from the communicating hole to the gas introducing hole, the first valve can be served as a negative-pressure control valve which opens the gas introducing hole when the pressure is reduced below a predetermined pressure. Moreover, when the first valve opens the gas introducing hole, since the second valve closes the communicating hole, the pressure fluctuation which is generated due to introducing of the gas through the gas introducing hole is not propagated to the buffer chamber via the communicating hole.

In the liquid jetting apparatus of the present invention, the gas introducing hole and the communicating hole may be positioned to face each other in a vertical direction, and the first valve may be displaced vertically to open and close the gas introducing hole and the communicating hole.

In this case, it is possible to close tightly the gas introducing hole or the communicating hole by a simple structure which causes only a vertical movement of the first valve.

In the liquid jetting apparatus of the present invention, the first valve may open the gas introducing hole, against the bias applied by the bias applying mechanism, due to a negative pressure which is generated in the gas distributing chamber when the liquid inside the liquid storage chamber has decreased by more than a predetermined amount.

In this case, when an excessive negative pressure is generated inside the liquid storage chamber, the opening and closing valve is opened and the gas distributing chamber which communicates with the liquid storage chamber is opened to the atmosphere, and the opening and closing valve also serves as a negative-pressure control valve. Accordingly, the structure of the apparatus is further simplified facilitating the reduction in space, and it is possible to further reduce the number of components and the cost.

In the liquid jetting apparatus of the present invention, the buffer chamber may not be provided with a negative-pressure control valve which opens to the atmosphere when a negative pressure inside the buffer chamber is below a predetermined value.

In this case, it is not necessary to provide separately a negative-pressure control valve to the buffer chamber, and accordingly, the structure of the apparatus can be further simplified facilitating the reduction in space, and it is possible to further reduce the number of components and the cost.

In the liquid jetting apparatus of the present invention, the gas introducing mechanism may further include a pipe member which introduces the gas into the gas introducing hole; and when the pipe member moves closer toward the gas introducing hole, the pipe member may communicate air-tightly with the gas distributing chamber and a front end of the pipe member may press into the first valve to open the gas introducing hole.

In this case, since the gas introducing hole is opened by pressing into the first valve by the front end portion of the gas introducing pipe member, it is not necessary to provide independently a driving source for driving the first valve, and accordingly, the structure of the apparatus can be further simplified, and it is possible to reduce the number of components and the cost.

In the liquid jetting apparatus of the present invention, a flexible seal member may be provided to the front end of the pipe member. In this case, when the pipe member makes a contact with the first valve, it is possible to maintain closely a contact portion between the pipe member and the first valve.

In the liquid jetting apparatus of the present invention, the second valve may have a ring-shaped seal member and may have a sheet-shaped seal member. In any of the cases, it is possible to secure an air-tightness of the second valve when closed. Particularly, when the second valve has a seal member in the form of a sheet, it is possible to improve a resisting pressure of the second valve.

In the liquid jetting apparatus of the present invention, a communicating passage having a groove-shape may be formed on an upper surface of a wall which defines an upper side of the liquid storage chamber, and the gas distributing chamber and the liquid storage chamber may be communicated via the communicating passage. In this case, since the gas distributing chamber and the liquid storage chamber communicate via the communicating passage, it is possible to send assuredly a gas flowed into the gas distributing chamber, to the liquid storage chamber. When the communicating passage has a labyrinth structure having an intricately bent path, since a channel resistance of the communicating passage becomes high, even when a sudden pressure fluctuation has generated in one of the gas distributing chamber and the liquid storage chamber, the pressure fluctuation is not transmitted directly to the other.

In the liquid jetting apparatus of the present invention, an upper surface of the buffer chamber and the communicating passage may be covered air-tightly by a resin film. In this case, since it is possible to simplify a structure of the communicating passage and the buffer chamber, it is possible to reduce the number of components and the cost.

In the liquid jetting apparatus of the present invention, the bias applying mechanism may include a helical spring. In this case, since it is possible to simplify a structure of the bias applying mechanism, it is possible to reduce the number of components and the cost.

According to the second aspect of the present invention, there is provided a liquid jetting apparatus which jets a liquid including:

a head which jets the liquid;

a liquid storage chamber which communicates with the head, and which stores the liquid to be supplied to the head;

a buffer chamber having an atmosphere opening hole which introduces an atmosphere formed therein, the buffer chamber being provided with a positive-pressure control valve which opens the atmosphere opening hole when a positive pressure inside the buffer chamber exceeds a predetermined value;

a gas distributing chamber in which a gas introducing hole and communicating hole are formed, the gas introducing hole communicating with the liquid storage chamber and the communicating hole communicating with the buffer chamber;

a gas introducing mechanism which introduces the gas through the gas introducing hole to feed the liquid in the liquid storage chamber to the head so that the liquid is forcibly jetted from the jetting head;

a piston which is provided in the gas distributing chamber, and which has a first portion and a second portion, the first and second portions being capable of sealing the gas introducing hole and the communication hole, respectively, wherein the piston is movable between a first and a second positions, the first position being a position at which the first portion seals the gas introducing hole and the second portion opens the communicating hole, and the second portion being a position at which the first portion opens the gas introducing hole and the second portion seals the communicating hole.

According to the present invention, it is possible to provide a positive-pressure purge function while suppressing an excessive increase in the pressure inside the liquid storage chamber, without increasing a size and raising a cost of the apparatus.

DETAILED DESCRIPTION OF THE PREFERRED EMBODIMENTS

Exemplary embodiments according to the present invention will be described below with reference to the accompanying diagrams.

First Embodiment

Figure 1:
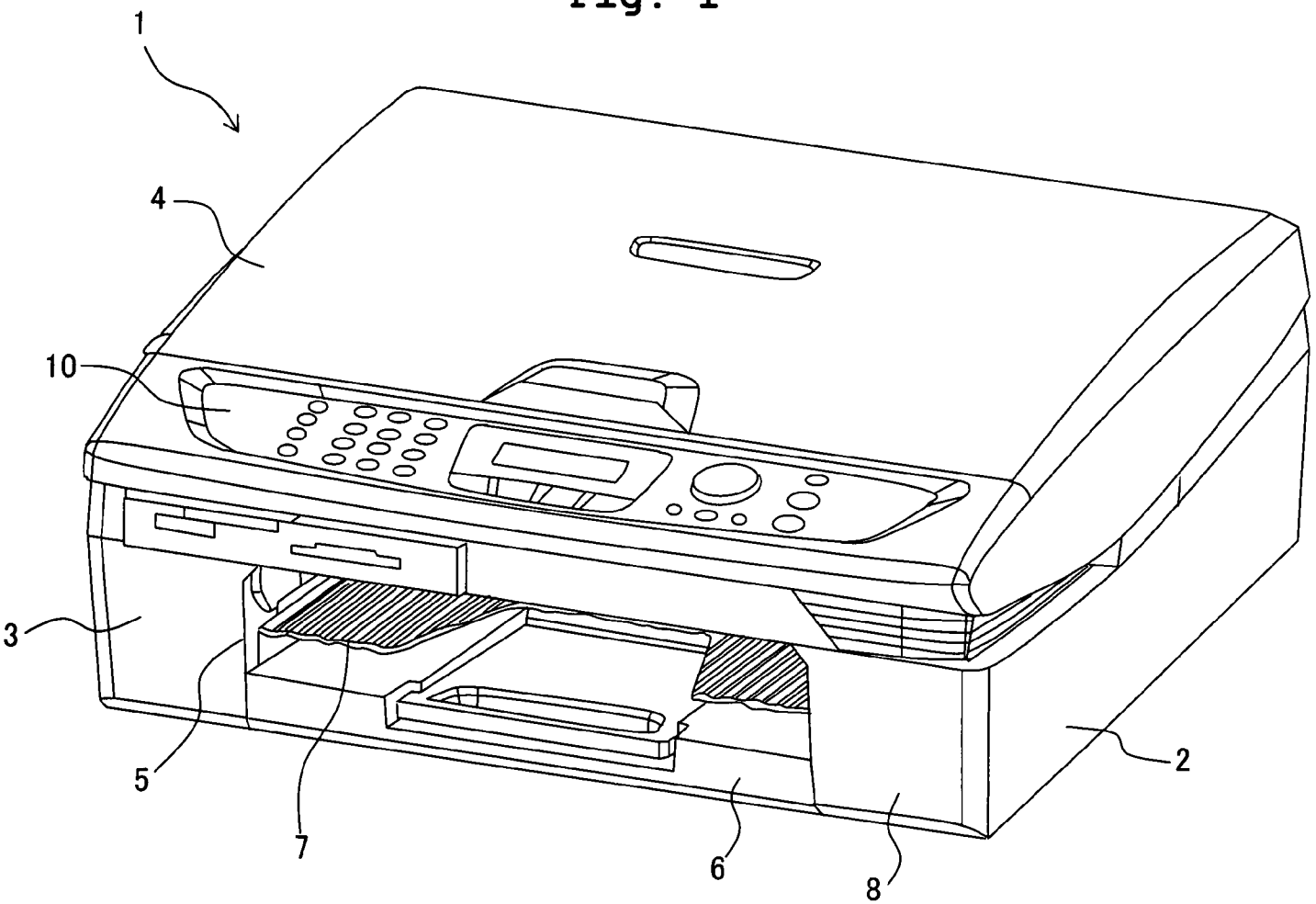
FIG. 1 is a perspective view showing a multi-function device having an ink-jet recording apparatus (liquid jetting apparatus) according to a first embodiment of the present invention.

FIG. 1 is a perspective view showing a multi-function device 1 having an ink-jet recording apparatus 3 (liquid jetting apparatus) according to a first embodiment of the present invention. The multi-function device 1 has a printer function, a scanner function, a copy function, and a facsimile function. As shown in FIG. 1, the multi-function device 1 has a casing 2, the ink-jet recording apparatus 3 for printing which is positioned at a lower portion of the casing 2, as well as a scanner unit 4 which is positioned at an upper portion of the casing 2. An opening 5 is formed in a front face of the casing 2. Two trays 6 and 7 are positioned in a stacked manner in the opening 5. In other words, a paper feeding tray 6 of the ink-jet recording apparatus 3 is provided at a lower stage in the opening 5, and a paper discharge tray 7 of the ink-jet recording apparatus 3 is provided at an upper stage (upper stand) of the opening 5. On a bottom-right portion of a front-face side of the ink-jet recording apparatus 3, a main-ink tank mounting portion 9 is provided, and a lid 8 is openably provided on a front surface of the main-ink tank mounting portion 9. On an upper portion front-face side of the multi-function device 1, an operation panel 10 for operating the ink-jet recording apparatus 3, the scanner unit 4 and the like is provided. Moreover, when the multi-function device 1 is connected to an external computer, it is possible to operate the multi-function device 1 based on instructions (commands) which are transmitted from the computer via a driver.

Figure 2:
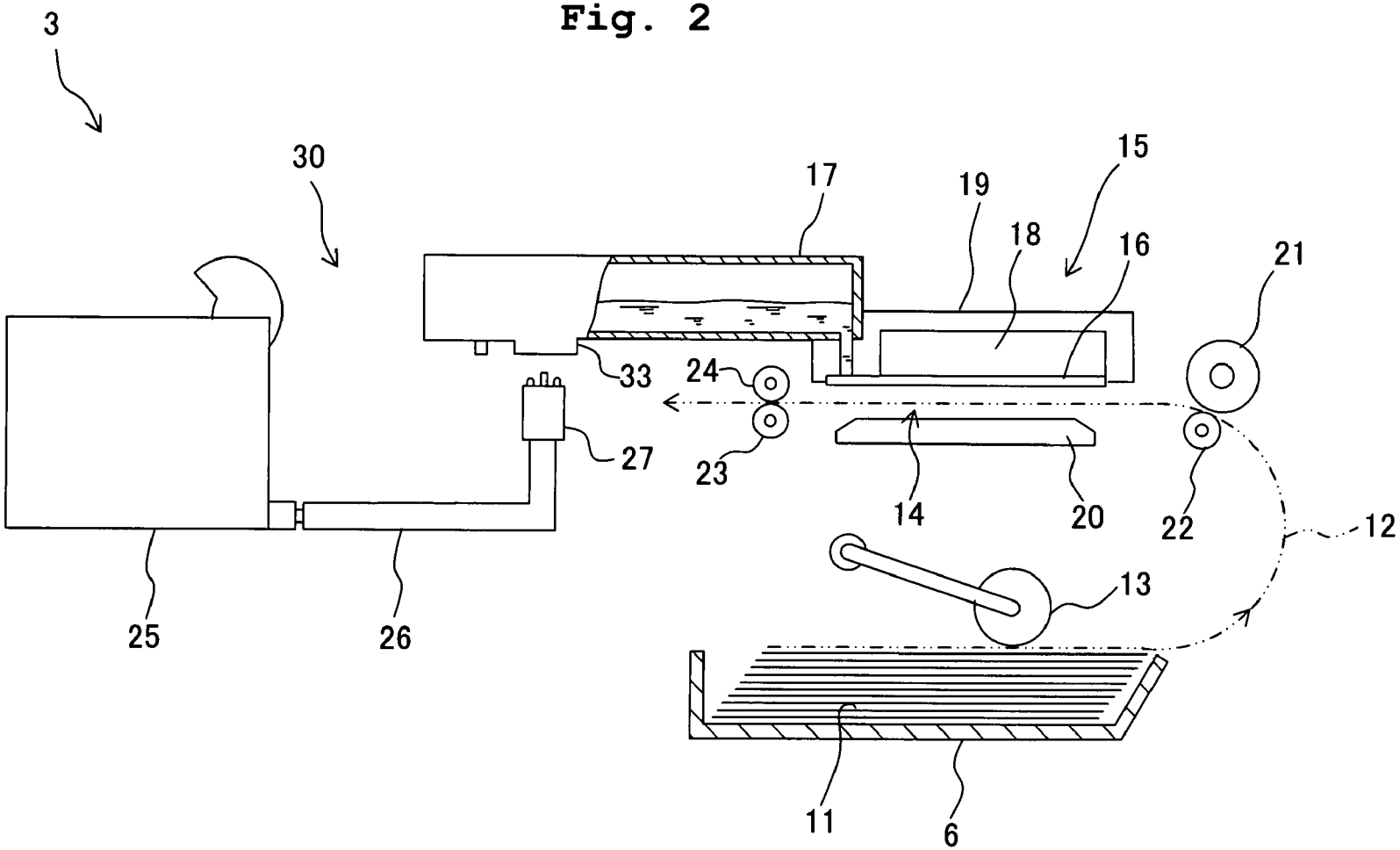
FIG. 2 is a cross-sectional view schematically describing the ink-jet recording apparatus of the multi-function device shown in FIG. 1.

FIG. 2 is a cross-sectional view describing the ink-jet recording apparatus 3 of the multi-function device 1 shown in FIG. 1. As shown in FIG. 2, the paper feeding tray 6 is arranged on a bottom side of the multi-function device 1. At an upper side of the paper feeding tray 6, a paper-feeding drive roller 13 which supplies a paper to a transporting path 12, the paper being arranged at a top of the stacked papers 11 in the paper feeding tray 6. The transporting path 12 is formed as a U-turn path which is extended upward from a rear-surface side, then extended toward a front-surface side upon taking a U-turn, and reaches the paper discharge tray 7 (refer to FIG. 1) upon passing through a printing area 14.

An image recording unit 15 is provided in the printing area 14. A platen 20 which is larger than a paper size, is arranged on a lower side of the image recording unit 15. On an upstream side of the image recording unit 15, a transporting roller 21 and a pinch roller 22 which pinch and transport the paper 11 passing through the transporting path 12 to the platen 20 are provided. On a downstream side of the image recording unit 15, a paper discharge roller 23 and a pinch roller 24 which pinch and transport the paper 11 subjected to image recording, to the discharge tray 7 (refer to FIG. 1) are provided.

The image recording unit 15 has a jetting head, of a known piezoelectric-type, which jets an ink (liquid) from a plurality of nozzle holes toward a paper 11 which is placed in the transporting path 12; a sub tank 17 which stores the ink which is to be supplied to the jetting head 16; a head controlling board 18 including an IC chip which drives and controls the jetting head 16; and a carriage 19 on which the jetting head 16, the sub tank 17 and the head controlling board 18 are mounted.

The sub tank 17 has a ink-inflow joint portion 33. An ink replenishing mechanism 30 is connected to the ink-inflow joint portion 33 according to the requirement, and the ink is replenished to the sub tank 17. The ink replenishing mechanism 30 has an ink tank 25 of a cartridge type, an ink supply tube 26 of which one end portion is connected to the main tank 25, and an ink-outflow joint portion 27 which is provided at the other end portion of the ink supply tube 26. The ink-outflow joint portion 27 is moved in a vertical direction by a drive mechanism which is not shown in the diagram. Accordingly, the ink-outflow joint portion 27 is attached to or detached from the ink-inflow joint portion 33 of the sub tank 17.

Figure 3:
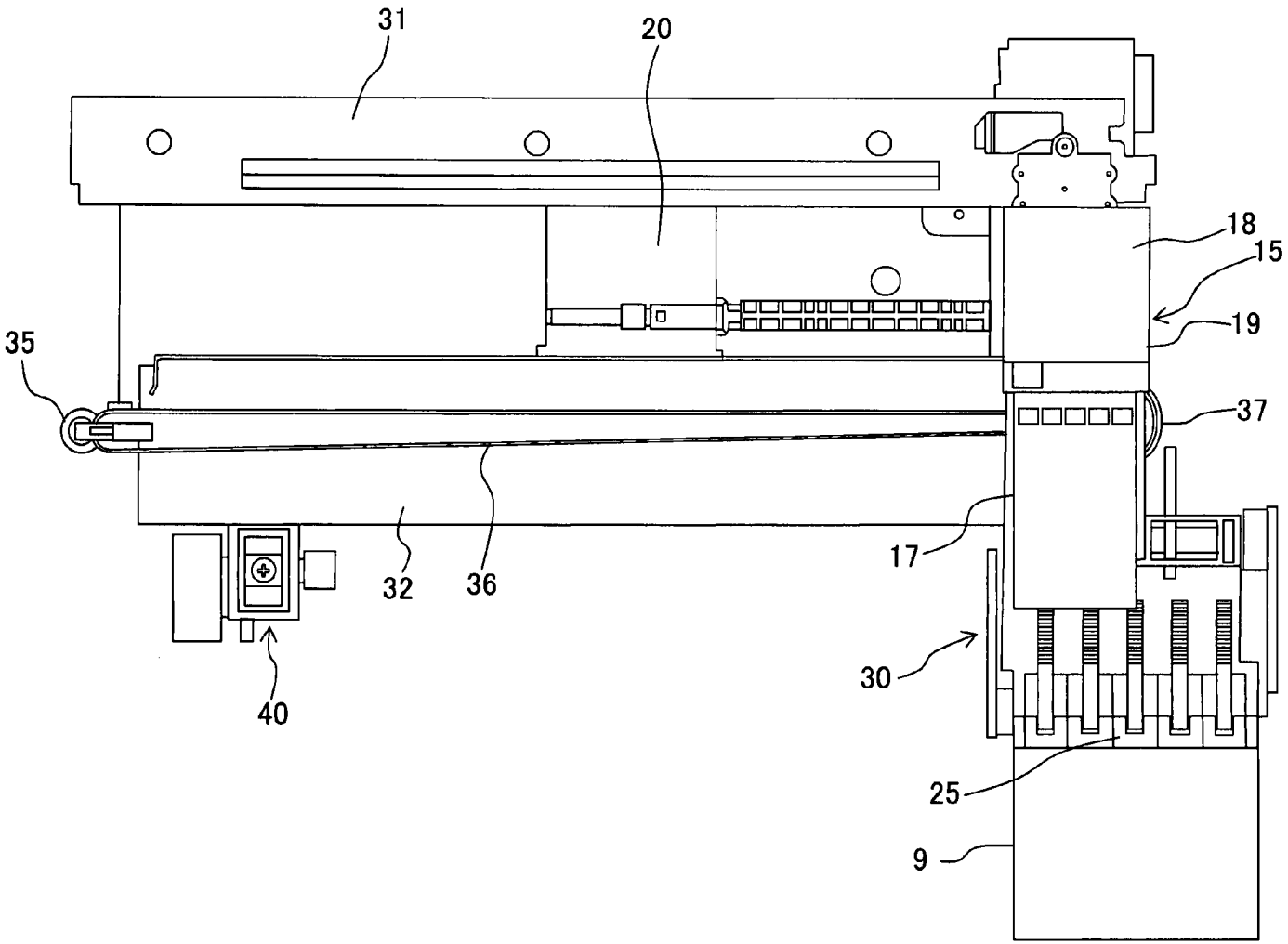
FIG. 3 is a plan view of main components in an ink replenishing state of the ink-jet recording apparatus of the multi-function device shown in FIG. 1.
Figure 4:
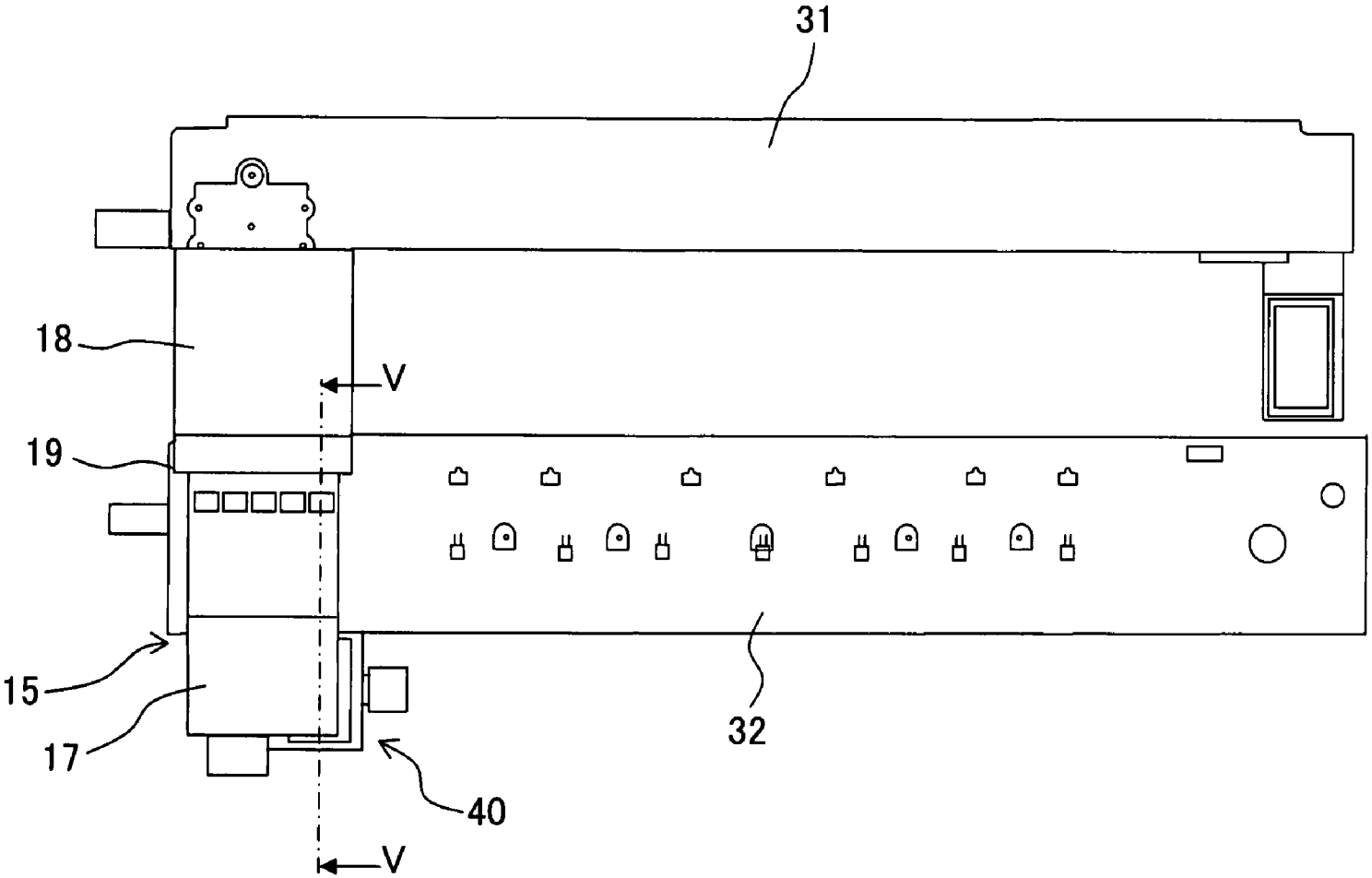
FIG. 4 is a plan view of main components in a maintenance state of the ink-jet recording apparatus of the multi-function device shown in FIG. 1.

FIG. 3 is a plan view showing a state of replenishing the ink to the ink-jet recording apparatus 3 of the multi-function device 1 shown in FIG. 1. FIG. 4 is a plan view showing a state of carrying out maintenance of the ink-jet recording apparatus 3 of the multi-function device 1 shown in FIG. 1. As shown in FIG. 3, a pair of guide rails 31 and 32, which is flat and which extends in a scanning direction orthogonal to a paper-transporting direction is provided at an upper side of the platen 20. Each of the guide rails 31 and 32 is provided on a substantially same plane, and is positioned horizontally such that an upper surface thereof is substantially parallel to an upper surface of the platen 20. The carriage 19 of the image recording unit 15 is movably supported on the guide rails 31 and 32 in an extending direction in which the guide rails 31 and 32 are extended.

A drive pulley (not shown in the diagram) and a driven pulley 35 are provided at both end portions in a scanning direction, on an upper surface of the guide rail 32 on a down stream side in the paper-transporting direction. A timing belt 36 in the form of a loop is put around the drive pulley and the driven pulley 35. A bottom surface of the carriage 19 is fixed to the timing belt 36. A motor 37 is coupled with a shaft of the drive pulley. Therefore, when the drive pulley rotates in a positive and a reverse direction (CW and CCW direction), the timing belt 36 put around the drive pulley and the driven pulley 35 moves in a circumferential direction. The carriage 19 having the jetting head 16 (refer to FIG. 2), the sub tank 17, and the head control substrate 18 are reciprocated integrally on the guide rails 31 and 32 along with the circumferential motion of the timing belt 36. The sub tank 17 has five ink storage chambers corresponding to inks of five colors used for printing. Moreover, the sub tank 17 is capable of storing an amount of ink not less than an amount of ink which is anticipated to be consumed in one printing process.

The ink replenishing mechanism 30 for replenishing the ink in the sub tank 17, and a positive-pressure purge mechanism 40 (gas infusing mechanism) for maintenance are arranged on an outer side of a printing area of passing of paper. The ink replenishing mechanism 30 is provided at a front side (lower side in FIG. 3) of the guide rail 32, at one end side (right side in FIG. 3) in the scanning direction of the carriage 19. The ink replenishing mechanism 30 has five main tanks 25 which are detachably mounted on a main-tank mounting portion 9 of a stationary type. The number of main tanks 25 corresponds to the types of ink.

As shown in FIGS. 3 and 4, the positive-pressure purge mechanism 40 is provided at a frontward side of the guide rail 32 (lower side in FIGS. 3 and 4), at the other end side (left side in FIG. 3) in the scanning direction of the carriage 19. At the time of maintenance, the carriage 19 is moved to a left-end portion of the guide rails 31 and 32, and a purge by the positive-pressure purge mechanism 40 is carried out. The positive-pressure purge mechanism 40 supplies compressed air (positive pressure) to the sub tank 17, and jets sludge and air bubbles accumulated in the jetting head 16 (refer to FIG. 2) toward a waste-ink tank (not shown in the diagram) (blank shot, blank jetting).

Figure 5:
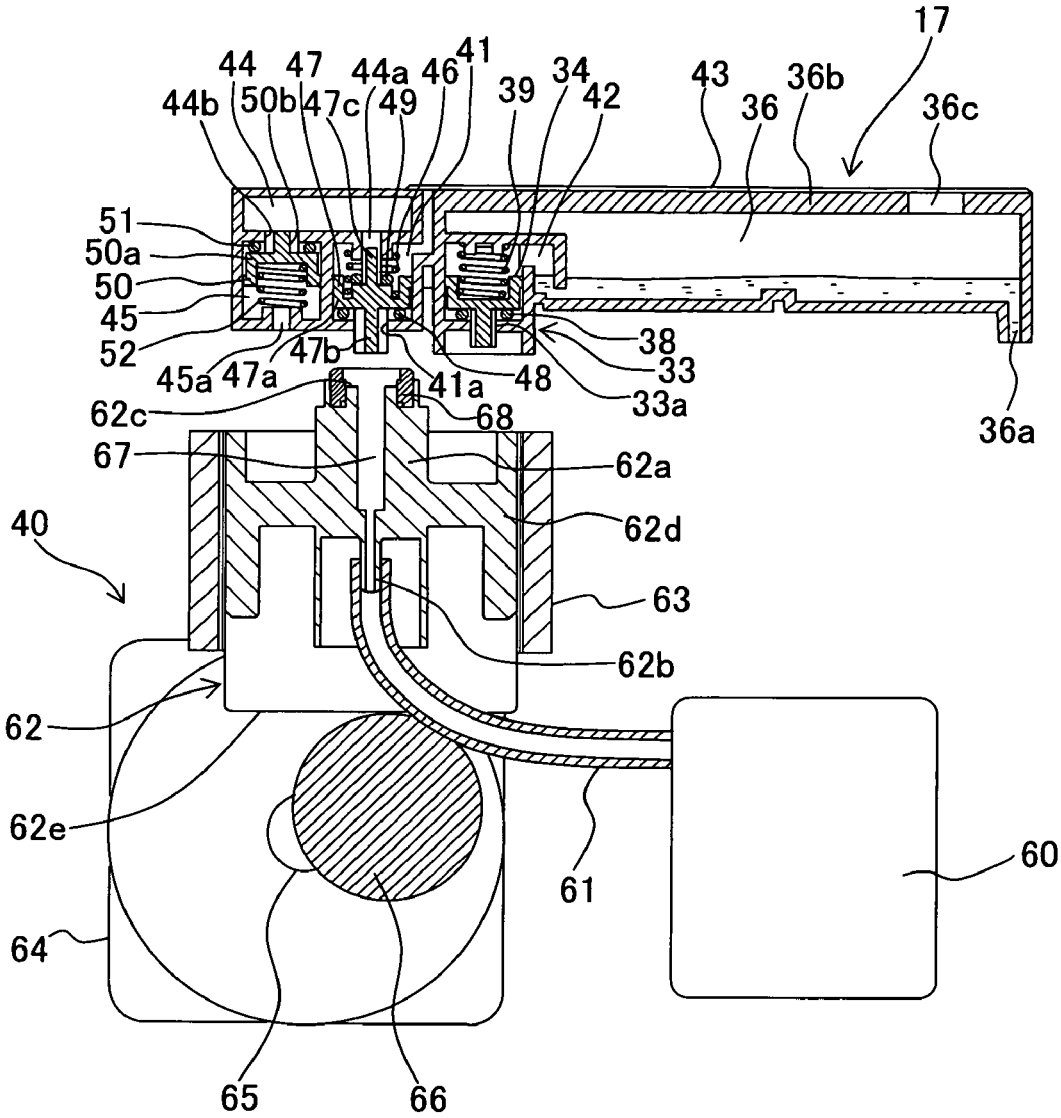
FIG. 5 is a cross-sectional view taken along a line V-V in FIG. 4, in which a combination valve is at a 'first position'.

FIG. 5 is a cross-sectional view taken along a line V-V, and shows a state in which an open-close valve 47 is at a 'first position' which will be described later. As shown in FIG. 5, the sub tank 17 includes an ink storage chamber 36, an ink distributing passage 42, a gas distributing chamber 41, a buffer chamber (a pressure buffer chamber) 44, a valve chamber (a chamber with valve) 45, and the ink-inflow joint portion 33 at a position corresponding to the ink-outflow joint portion 27 (refer to FIG. 2). An inflow port 33*a* which opens to the outside is formed in a lower wall of the ink-inflow joint portion 33, and the ink-inflow joint portion 33 has an inflow-port valve 34 which opens and closes the inflow port 33*a* by moving in a vertical direction, a seal ring 38 which is provided around the inflow port 33*a*, and a coil spring 39 which applies a bias to the inflow-port valve 34 toward the seal ring 38.

An upper portion of the ink-inflow joint portion 33 communicates with the ink storage chamber 36 via the ink distributing passage 42. An outflow hole 36*a* is provided in a lower wall (bottom wall) of the ink storage chamber 36, and the ink inside the ink storage chamber 36 flows from the outflow hole 36*a* to the jetting head 16 (refer to FIG. 2). A communicating port 36*c* which communicates with an air layer at an upper-portion of the ink storage chamber 36 is formed in an upper wall 36*b* of the ink storage chamber 36. The gas distributing chamber 41 which is adjacent to the ink inflow joint portion 33 is provided to the sub tank 17. The gas distributing chamber 41 is positioned at a side of the ink inflow joint portion 33 opposite to the ink storage chamber 36 (left side in FIG. 5). A labyrinth channel which is not shown in the diagram is formed in the upper wall 36*b* of the ink storage chamber 36. Since a resin film 43 is stuck on an upper surface of the upper wall 36*b* of the ink storage chamber 36, the labyrinth channel is sealed air tightly with respect to an outside air by the resin film 43. The gas distributing chamber 41 communicates with the ink storage chamber 36 via the labyrinth channel. The gas distributing chamber 41 communicates with an outside by a gas infusing hole 41*a* which is formed in a lower (bottom) wall thereof. Moreover, the gas distributing chamber 41 communicates with the buffer chamber 44 through a communicating hole 44*a* formed in an upper wall thereof. The gas infusing hole 41*a* and the communicating hole 44*a* are formed to be facing vertically.

The open-close valve (combination valve) 47 which moves in a vertical direction is provided to the gas distributing chamber 41. The combination valve (combined valve) 47 has a seat portion 47*a*, a contact shaft 47*b* which is protruded downward from the seat portion 47*a*, through the gas infusing hole 41*a*, and a guide shaft 47*c* which is protruded upward from the seat portion 47*a* and inserted through the communicating hole 44*a*. A small gap (clearance) is formed between the seat portion 47*a* and an inner-wall surface of the gas distributing chamber 41. In other words, the seat portion 47*a* is arranged leaving a space (gap) in a circumferential direction with respect to the inner-wall surface of the gas distributing chamber 41. An inside of the gas distributing chamber 41 is divided into two spaces in a vertical direction by the seat portion 47*a*, and these two spaces communicate mutually via the gap. Moreover, a gap is formed in a circumferential direction partially between the contact shaft 47*b* and an inner peripheral surface of a lower wall of the gas distributing chamber 41, forming (defining) the gas infusing (introducing) hole 41*a*. The upper and lower spaces sandwiching the gas infusing hole 41*a* communicate mutually through this gap. Further, a gap is formed in a circumferential direction partially between the guide shaft 47*c* and an inner peripheral surface, of an upper wall of the gas distributing chamber 41, defining the communicating hole 44*a*. The upper and lower spaces sandwiching the communicating hole 44*a* communicate mutually through this gap.

A seal ring 48 is fixed around the gas infusing hole 41*a* of the inner surface of the gas distributing chamber 41. The combination valve 47 is provided with a coil spring 46 (bias applying mechanism) which applies a bias in a direction of moving the seat portion 47*a* away from the communicating hole 44*a*. Since the bias is applied to the seat portion 47*a* such that the seat portion is in a close contact with the seal ring 48, the gas infusing hole 41*a* is closed (blocked) by the combination valve 47. In the present patent application specification, a position of the combination valve 47 when the combination valve 47 is descended down up to a lower limit in a range of movement and closes (blocks) the gas infusing hole 41*a*, and has opened the communicating hole 44*a* is defined as a 'first position'.

Moreover, a seal member 49 in the form of a ring in which the guide shaft 47*c* is fitted externally, on an upper surface of the seat portion 47*a* is fixed to the combination valve 47. Consequently, when the combination valve 47 moves up to an upper limit of the range of movement thereof and opens the gas infusing hole 41*a*, the seal member 49 makes a close contact with a wall surface around the communicating hole 44*a*, and the communicating hole 44*a* is closed (blocked). At this time, since a communication between the buffer chamber 44 and the gas distributing chamber 41 is cut off, a volume of a space communicating with the ink storage chamber 36 is decreased by an amount equivalent to (a volume of) the buffer chamber 44. In this manner, the combination valve 47 has a function of changing the volume of the space communicating with the ink storage chamber 36.

Further, when a negative pressure lower than a predetermined value is generated in the buffer chamber 44, the combination valve 47 is separated apart from the seal ring 48 resisting the coil spring 46, and the gas infusing hole 41*a* is opened. At this time, since the gas distributing chamber 41 is opened to the atmosphere through the gas infusing hole 41*a*, the ink storage chamber 36 and the buffer chamber 44 communicating with the gas distributing chamber 41 are also opened. In this manner, the open-close valve 47 has a function as a negative-pressure vent valve in addition to a control of changing the volume of the space described above.

A first atmosphere opening hole 44*b* which communicates with the valve chamber 45 adjacent to the gas distributing chamber 41 is formed in a lower wall (bottom wall) of the buffer chamber 44. The valve chamber 46 is provided with a positive-pressure control valve 50 which opens and closes the first atmosphere opening hole 44*b*. The positive-pressure control valve 50 has a seat portion 50*a* and a shaft 50*b* which protrudes upward from the seat portion 50*a* and is inserted into the first atmosphere opening hole 44*a*. A gap is formed partially between the seat portion 50*a* and an inner peripheral surface of the valve chest 45, and an upper space and a lower space of the valve chest 45 sandwiching the seat portion 50*a*, communicate mutually through this gap. A gap is formed partially between the shaft 50*b* and an inner peripheral surface of a lower wall (bottom wall) of the valve chest 45, forming (defining) the first atmosphere opening hole 44*b*, and the upper space and the lower space sandwiching the first atmosphere opening hole 44*b* communicate mutually through this gap.

A seal ring 51 is fixed around the first atmosphere opening hole 44*b* of the inner surface of the valve chest 45. The positive-pressure control valve (positive-pressure vent valve) 50 is provided with a coil spring 52 which applies bias to the seat portion 50*a*, toward the seal ring 51. Moreover, a second atmosphere opening hole 45*a* is formed in the lower wall of the valve chamber 45. When a pressure of a predetermined value or more is generated in the buffer chamber 44, the positive-pressure control valve 50 is separated apart from the seal ring 51 resisting the coil spring 52, and the first atmosphere opening hole 44*b* is opened. At this time, the buffer chamber 44 is opened to the atmosphere through the first atmosphere opening hole 44*b* and the second atmosphere opening hole 45*a*, and furthermore, the gas distributing chamber 41 and the ink storage chamber 36 which communicate with the buffer chamber 44 are opened to the atmosphere. The pressure distributing chamber 44 is not provided with a negative-pressure control valve which opens to the atmosphere when the negative pressure inside the buffer chamber 44 has been below a predetermined value.

The positive-pressure purge mechanism 40 (gas introducing mechanism, gas infusing mechanism) is arranged at a lower side of the combination valve 47. The positive-pressure purge mechanism 40 includes a pressurizing pump 60 which supplies compressed air, a flexible tube 61 which derives the compressed air from the pressurizing pump 60, a gas infusing pipe member 62 which is connected to a front end of the flexible tube 61, an eccentric cam 66 which makes a contact with the gas infusing pipe member 62 from a lower side, a motor 64 which drives and rotates the eccentric cam 66, and a guide body 63 which is arranged to guide slidably the gas infusing pipe member (gas introducing pipe member) 62 up and down in a vertical direction.

The gas infusing pipe member 62 has a pipe portion 62*a* which forms an internal channel 67, a lower-end connecting portion 62*b* which is protruded downward from the pipe member 62*a* and is connected to the flexible tube 61 communicating with the internal channel 67, a front end portion 62*c* which is protruded upward from the pipe portion 62 and is facing the combination valve 47 of the pipe portion 62*a*, a guided portion 62*d* which is protruded sideward from the pipe portion 62*a* and makes a slidable contact with an inner-side surface of the guide body 63, and a driven portion 62*e* which is pushed from a lower side by the eccentric cam 66. The front end portion 62*c* of the gas infusing pipe member 62 is positioned at a lower side of a contact shaft 47*b* of the combination valve 47. A seal member 68 in the form of a ring is fixed to the front end portion 62*c* of the gas infusing pipe member 62. The seal member 68 is protruded upward than the front end portion 62*c*, and makes a close contact with a lower surface (bottom surface) of the gas distributing chamber 41 to surround the gas infusing hole 41, when the gas infusing pipe member 62 has ascended up.

Figure 6:
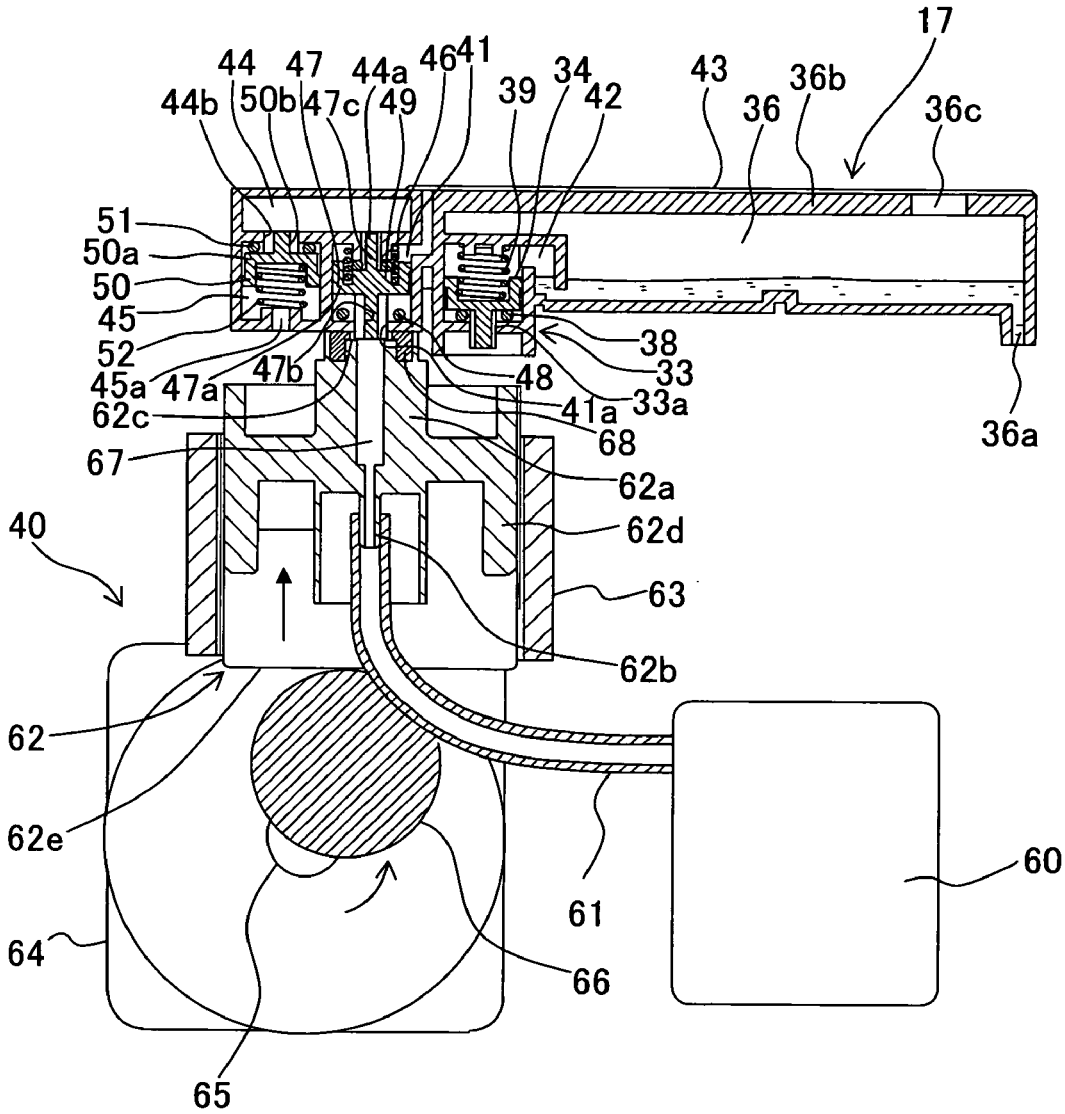
FIG. 6 is a cross-sectional view of the same cross section in FIG. 5, in which the combination valve is at a 'second position'.

FIG. 6 is a cross-sectional view of the same cross section in FIG. 5, showing a state in which the combination valve 47 is at a 'second position'. As shown in FIG. 6, when a drive shaft 65 of the motor 64 rotates, the disk-shaped eccentric cam 66 which is fixed eccentrically to the drive shaft 65 pushes up the driven portion 62*e* of the gas infusing pipe member 62. At this time, the gas infusing pipe member 62 ascends up along the guide 63, and the seal member 68 makes a close contact with a surrounding of the gas infusing hole 41*a*, of the lower surface of the gas distributing chamber 41. At the same time, the front end portion 62*c* pushes the contact shaft 47*b* of the combination valve 47 and opens the gas infusing hole 41*a*. As a result of this, the internal channel 67 of the gas infusing pipe member 62 communicates with the gas distributing chamber 41 via the gas infusing hole 41*a*, while maintaining an airtightness with the outside air.

Next, when the combination valve 47 moves up to an upper limit of the range of movement, the seal member 49 of the combination valve 47 makes a close contact with a surface wall around the communicating hole 44*a*, and the communicating hole 44*a* is sealed. When the communicating hole 44*a* is sealed, since the buffer chamber 44 and the gas distributing chamber 41 are cut off, the volume of the space communicating with the ink storage chamber 36 is decreased by an amount equivalent to the volume of the buffer chamber 44. In this specification, a position of the combination valve 47, at which the combination valve 47 is ascended up to the upper limit in the range of movement and opens the gas infusing hole 41*a* and has closed the communicating hole 44*a*, is defined as the 'second position'.

In the 'second position', when the pressurized pump 60 is operated, it is possible to infuse the compressed air into the gas distributing chamber 41 through the gas infusing pipe member 62 and the gas infusing hole 41*a*. At this time, the positive pressure due to the compressed air is transmitted to the ink storage chamber 36 without being transmitted to the buffer chamber 44, and the ink inside the ink storage chamber 36 is sent forcibly to the jetting head 16 (refer to FIG. 2) through the ink outflow hole 36*a*. As a result, the ink is jetted forcibly from the nozzle holes (not shown in the diagram) of the jetting head 16, and ink thickened due to drying, and impurities which had blocked the nozzle holes are discharged to the outside (positive-pressure purge operation).

As described above, in case the combination valve 47 is located at the 'first position', when an excessive positive pressure is generated in the ink storage chamber 36, the positive pressure is transmitted to the buffer chamber 44 via the gas distributing chamber 41. Therefore, the positive-pressure control valve 50 is operated and the first atmosphere opening hole 44*b* is opened. Accordingly, the ink storage chamber 36 is opened to the atmosphere through the first atmosphere opening hole 44*b* and the second atmosphere opening hole 45*a*, and the excessive positive pressure is suppressed from being generated inside the ink storage chamber 36. On the other hand, in a case of carrying out the positive-pressure purge by pressurizing the ink storage chamber 36 by infusing (introducing) the compressed air from the gas infusing hole 41*a*, the communicating hole 44*a* is closed by the combination valve 47. Since the positive pressure in the ink storage chamber 36 is not transmitted to the buffer chamber 44, the pressure is not lead to the outside from the positive-pressure control valve 50. Therefore, it is possible to carry out the purge operation even with a comparatively lower pressure (comparatively lower positive pressure). Accordingly, a high pressure pump is not required to be used as the pressurizing pump 60 which supplies the positive pressure for the purge, and it is possible to prevent an increase in a size and a cost of the apparatus.

Furthermore, when the communicating hole 44*a* is not sealed, the buffer chamber 44 communicates with the gas distributing chamber 41. Therefore, a volume of a space communicating with the ink storage chamber 36 is increased. Therefore, it is possible to absorb by the buffer chamber 44 a pressure fluctuation which is developed in the ink storage chamber 36. On the other hand, at the time of the positive pressure purge, since the communicating hole 44*a* is closed by the combination valve 47, the volume of the space communicating with the ink storage chamber 36 is decreased by an amount equivalent to the volume of the buffer chamber 44. Therefore, the positive pressure to be applied to the ink storage chamber 36 at the time of the positive pressure purge is susceptible to be transmitted easily to the jetting head 16 (refer to FIG. 2). Accordingly, the pressure required to the pressurizing pump 60 can be reduced, and it is possible to prevent the increase in the side and the cost of the apparatus.

Moreover, in the combination valve 47, a cutoff valve (open-close valve) which opens and closes the gas infusing hole 41*a* and a cutoff valve which opens and closes the communicating hole 44*a* are provided integrally, and the combination valve 47 have functions of both the cutoff valves. Therefore, a cutoff valve for the communicating hole 44*a* and a cutoff valve for the gas infusing hole 41*a* are not required to be provided independently, and independent drive sources for these two cutoff valves are also not required to be provided. Accordingly, it is possible to simplify a structure of the apparatus, and to facilitate saving of space. It is also possible to reduce the number of components and cost of the apparatus.

Moreover, when a negative pressure not more than a predetermined pressure is generated in the gas distributing chamber 41 due to a decrease in an amount of ink in the ink storage chamber 36 by more than a predetermined amount, the combination valve 47 overcomes the bias of (force imparted by) the coil spring 4, thereby opening the gas infusing hole 41*a*, and opening the ink storage chamber 36 to the atmosphere. In other words, the combination valve 47 for the positive pressure purge functions not only as a diverter valve which changes the volume of the space communicating with the ink storage chamber 36, but also as a negative-pressure control valve which opens to the atmosphere when an excessive negative pressure is generated. Accordingly, a negative-pressure control valve is not required to be provided to the buffer chamber 44.

Furthermore, since the combination valve 47 opens the gas infusing hole 41*a* by being pushed up directly by the front end portion 62*c* of the gas infusing pipe member 62, a drive source for opening and closing the combination valve 47 is not required to be provided independently (separately), and it is possible to simplify the structure of the apparatus and to reduce the number of components and the cost of the apparatus. In the first embodiment, the seal ring 48 is fixed to the inner surface of the gas distributing chamber 41. However, the seal ring 48 may be fixed to a lower surface of the seat portion 47*a* of the combination valve 47. Moreover, the seal member 49 is fixed to the upper surface of the seat portion 47*a* of the combination valve 47. However, the seal member 49 may be fixed toward (at a side of) the communicating hole 44*a*.

Second Embodiment

Figure 7:
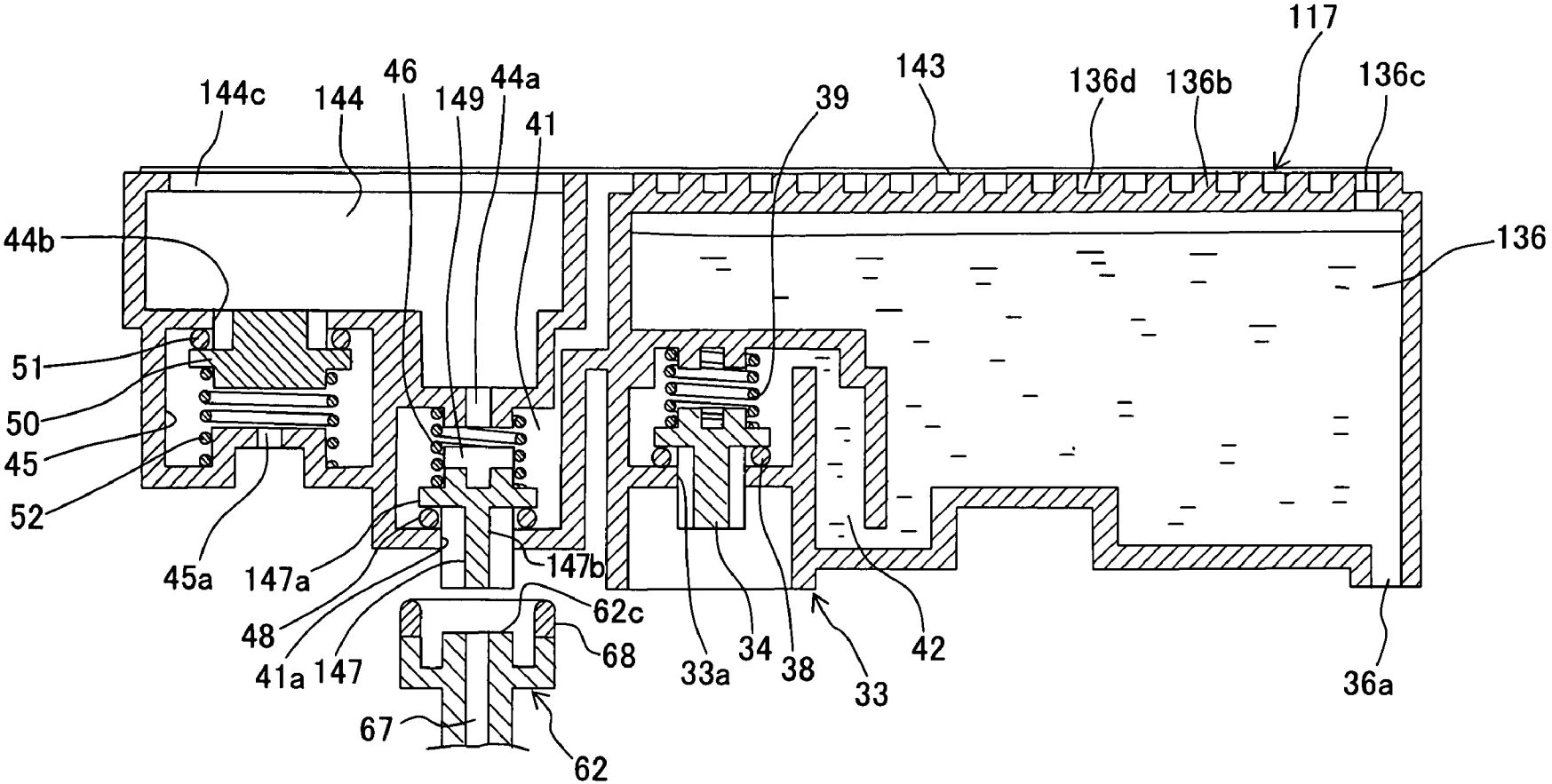
FIG. 7 is a cross-sectional view in which the combination valve of a second embodiment of the present invention is at a 'first position'.

Next, a second embodiment will be described below. FIG. 1 is a cross-sectional view showing a state in which a combination valve 147 of the second embodiment of the present invention is at a 'first position'. A point of difference from the first embodiment is that a seal member 149 which closes (blocks) the communicating hole 44*a* is different. Same reference numerals are assigned to components having the same structure as in the first embodiment, and the description thereof is omitted. As it is shown in FIG. 7, a communicating port 136*c* is formed in an upper wall portion 136*b* of an ink storage tank 136 of a sub tank 117 of the second embodiment. A labyrinth channel 136*d* having a meander shape in a plan view is formed as a groove, on an upper surface of the upper wall portion 136*b*. One end portion of the labyrinth channel 136*d* communicates with the communicating port 136*c* and the other end portion of the labyrinth channel 136*d* communicates with the gas distributing chamber 41.

The combination valve 147 is inserted to be movable in a vertical direction, in the gas distributing chamber 41. The combination valve 147 includes a seat portion 147*a*, and a contact shaft 147*b* which is protruded downward upon passing from the seat portion 147*a* to the gas infusing hole 41*a*. A seal member 149 is fixed to an upper surface of the seat portion 147*a*, facing the communicating hole 44*a*. The seal member 149 has an area which is enough to seal the communicating hole 44*a* and the surrounding thereof in a plan view. The seal member 149 has a sealing pressure higher than a sealing pressure of the seal ring 48 which seals the gas infusing hole 41*a*. For example, the seal ring 48 has a seal resisting pressure near 2 KPa negative pressure whereas the seal member 149 has a seal resisting pressure of 60 KPa or more positive pressure.

An opening 144*c* is formed in an upper wall of a buffer chamber 144, and by affixing a resin film 143 on an entire upper surface of the sub tank 117, the communicating port 136*c* and the labyrinth channel 136*d* are closed, and the opening 144*c* is also closed.

Figure 8:
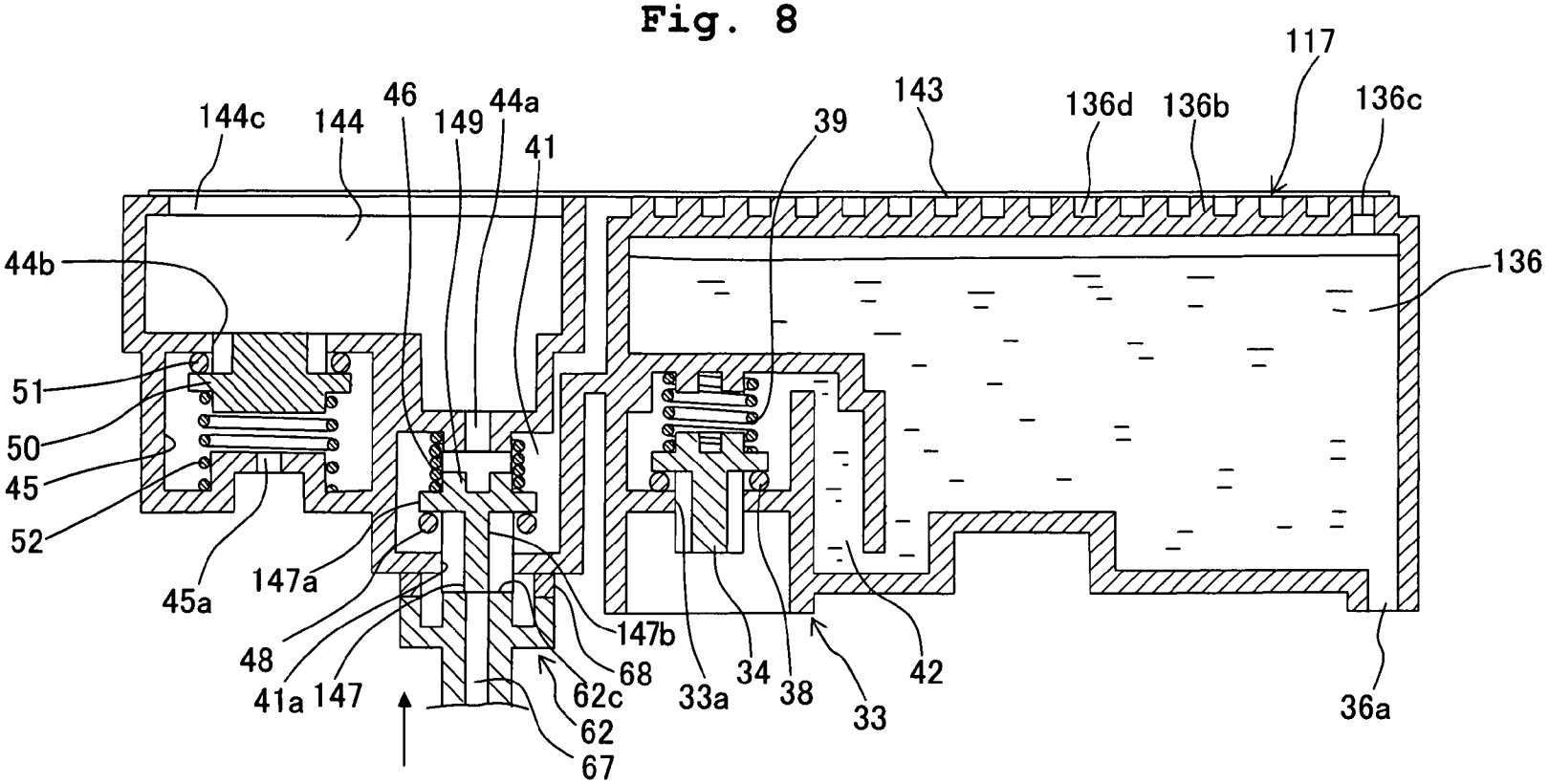
FIG. 8 is a cross-sectional view of the same cross section in FIG. 7 in which, the combination valve is at a 'second position'.

FIG. 8 is a cross-sectional view of the same cross section in FIG. 7 showing a state in which the combination valve 147 is at a 'second position'. As shown in FIG. 8, when the gas infusing pipe member 62 is moved to be ascended up, the seal member 68 makes a close contact with the surrounding of the gas infusing hole 41*a*, and pushes upward the contact shaft 147*b* of the combination valve 147 by the front end portion 62*c* and opens the gas infusing hole 41*a*. When the gas infusing hole 41*a* is opened, while maintaining the airtightness with the outside air, the internal channel 67 of the gas infusing pipe member 62 communicates with the gas distributing chamber 41 via the gas infusing hole 41*a*, the seal member 149 of the combination valve 147 makes a close contact with the communicating hole 44*a* and the surrounding thereof, and the communicating hole 44*a* is closed tightly. When the communicating hole 44*a* is closed tightly, a communication between the buffer chamber 144 and the gas distributing chamber 41 is cut off, and the volume of the space communicating with the ink storage chamber 36 is decreased by an amount equivalent to the volume of the buffer chamber 44.

The seal member 149 has a seal resisting pressure higher than the seal resisting pressure of the seal ring 48. The seal member 149 carries out sealing at the time of the positive pressure purge in which the compressed air is supplied to the gas distributing chamber 41. On the other hand, the seal ring 48 carries out sealing normally. Therefore, it is possible to carry out the positive-pressure purge operation more stably. The rest of the structure being similar as in the first embodiment, the description thereof is omitted.

In each embodiment described above, a helical spring (coil spring) has been used for the bias applying mechanism which applies a bias to each valve. However, the present invention is not restricted to using the helical spring, and a bias may be applied by magnetic force by using an electromagnet or a permanent magnet.

Each embodiment described above is an embodiment in which the present invention is applied to an ink-jet recording apparatus. However, the present invention may be applied to an apparatus which jets a liquid other than ink. For example, the present invention is applicable to various liquid-droplet jetting apparatuses which are used for forming a fine wiring pattern on a substrate by jetting an electroconductive paste, or forming a highly defined display by jetting an organic illuminant (emitter), and further for forming a very small electronic device such as an optical guided wave path by jetting an optical resin on a substrate. Moreover, in each embodiment described above, the sub tank is structured by forming chambers such as the buffer chamber and the gas distributing chamber integrally with the ink storage chamber. However, the chambers such as the buffer chamber and the gas distributing chamber may be formed separately from the ink storage chamber.

As described above, the liquid jetting apparatus according to the present invention has an excellent effect of being capable of providing a positive-pressure purge function without increasing the size and the cost of the apparatus while suppressing an excessive increase in the pressure of the liquid storage chamber, and it is widely applicable to ink-jet recording apparatuses which are capable of exerting a significance of this effect.

What is claimed is:

1. A liquid jetting apparatus which jets a liquid, comprising:

a head which jets the liquid;

a liquid storage chamber which communicates with the head, and in which the liquid to be supplied to the head is stored;

a gas distributing chamber communicating with the liquid storage chamber, and having a gas introducing hole in which a gas, to be fed to the liquid storage chamber, is formed;

a first valve which opens and closes the gas introducing hole;

a gas introducing mechanism which introduces the gas through the gas introducing hole to feed the liquid in the liquid storage chamber to the head so that the liquid is forcibly jetted from the head;

a buffer chamber having a communicating hole and an atmosphere opening hole formed therein, the communicating hole communicating with the gas distributing chamber, and the atmosphere opening hole introducing an atmosphere;

a positive-pressure control valve which opens the atmosphere opening hole when a positive pressure inside the buffer chamber exceeds a predetermined value; and a second valve which opens and closes the communicating hole;

wherein the first valve and the second valve are formed integrally;

wherein an air layer is formed in the liquid storage chamber, and the gas introducing hole communicates with the air layer;

wherein the gas introducing hole is formed to face the communicating hole;

wherein the liquid jetting apparatus further comprises a bias applying mechanism which applies a bias in a direction in which the first valve is separated away from the communicating hole to close the gas introducing hole; and wherein, when the first valve opens the gas introducing hole against the bias applied by the bias applying mechanism, the second valve closes the communicating hole.

2. The liquid jetting apparatus according to claim 1;

wherein when the first valve opens the gas introducing hole, the second valve closes the communicating hole; and when the first valve closes the gas introducing hole, the second valve opens the communicating hole.

3. The liquid jetting apparatus according claim 1;

wherein the first valve opens the gas introducing hole, against the bias applied by the bias applying mechanism, due to a negative pressure which is generated in the gas distributing chamber when the liquid inside the liquid storage chamber has decreased by more than a predetermined amount.

4. The liquid jetting apparatus according claim 1:

wherein the second valve has a ring-shaped seal member.

5. The liquid jetting apparatus according to claim 1;

wherein the second valve has a sheet-shaped seal member.

6. The liquid jetting apparatus according claim 1;

wherein the bias applying mechanism includes a helical spring.

7. The liquid jetting apparatus according to claim 1;

wherein the gas introducing hole and the communicating hole are positioned to face each other in a vertical direction, and the first valve is displaced vertically to open and close the gas introducing hole and the communicating hole.

8. The liquid jetting apparatus according to claim 7;

wherein the buffer chamber is not provided with a negative-pressure control valve which opens to the atmosphere when a negative pressure inside the buffer chamber is below a predetermined value.

9. The liquid jetting apparatus according to claim 1;

wherein a communicating passage having a groove-shape is formed on an upper surface of a wall which defines an upper side of the liquid storage chamber, and the gas distributing chamber and the liquid storage chamber are communicated via the communicating passage.

10. The liquid jetting apparatus according to claim 9;

wherein an upper surface of the buffer chamber and the communicating passage are covered air-tightly by a resin film.

11. A liquid jetting apparatus which jets a liquid, comprising:

a head which jets the liquid;

a liquid storage chamber which communicates with the head, and in which the liquid to be supplied to the head is stored;

a gas distributing chamber communicating with the liquid storage chamber, and having a gas introducing hole in which a gas, to be fed to the liquid storage chamber, is formed;

a first valve which opens and closes the gas introducing hole;

a gas introducing mechanism which introduces the gas through the gas introducing hole to feed the liquid in the liquid storage chamber to the head so that the liquid is forcibly jetted from the head;

a buffer chamber having a communicating hole and an atmosphere opening hole formed therein, the communicating hole communicating with the gas distributing chamber, and the atmosphere opening hole introducing an atmosphere;

a positive-pressure control valve which opens the atmosphere opening hole when a positive pressure inside the buffer chamber exceeds a predetermined value; and a second valve which opens and closes the communicating hole;

wherein the first valve and the second vale are formed integrally;

wherein an air layer is formed in the liquid storage chamber, and the gas introducing hole communicates with the air layer;

wherein the gas introducing mechanism further includes a pipe member which introduces the gas into the gas introducing hole; and when the pipe member moves closer toward the gas introducing hole, the pipe member communicates air-tightly with the gas distributing chamber and a front end of the pipe member presses into the first valve to open the gas introducing hole.

12. The liquid jetting apparatus according to claim 11, wherein a flexible seal member is provided to the front end of the pipe member.

* * * * *